United States Patent [19]

Bennett et al.

[11] Patent Number: 4,825,614

[45] Date of Patent: May 2, 1989

[54] NON-PENETRATING VENEER ANCHOR

[75] Inventors: David J. Bennett, Minneapolis; Mark C. Forbes, Eden Prairie, both of Minn.

[73] Assignee: Bennett, Ringrose, Wolfsfeld, Jarvis, Gardner, Inc., Minneapolis, Minn.

[21] Appl. No.: 173,199

[22] Filed: Mar. 24, 1988

[51] Int. Cl.[4] ..... E04B 1/60; E04B 1/64

[52] U.S. Cl. ..... 52/410; 52/746; 52/747; 52/513; 52/712

[58] Field of Search ..... 52/410, 379–381, 52/409, 746, 747, 383, 712, 513

[56] References Cited

U.S. PATENT DOCUMENTS

| | | | |
|---|---|---|---|
| 3,041,219 | 6/1962 | Steck | 52/409 |
| 3,942,292 | 3/1976 | Robinson | 52/204 |
| 4,519,175 | 5/1985 | Resan | 52/410 |
| 4,672,787 | 6/1987 | Murphy | 52/409 |

*Primary Examiner*—James L. Ridgill, Jr.
*Attorney, Agent, or Firm*—Merchant, Gould, Smith, Edell, Welter & Schmidt

[57] ABSTRACT

An anchoring system and method for fastening a plurality of veneer units (12) to a substrate wall (11) with a waterproof membrane (13) therebetween. The anchoring system (10) comprises a membrane-holding means (14) which is attached to the substrate wall (11) and holds the membrane proximate the wall (11) without puncturing the membrane (13). The anchoring system (10) also includes a support and tie structure (20) including a stationary anchor (19) and a vertically slidable, horizontal tie (24) which is positioned between adjacent units of veneer (12) for stabilization of the veneer wall. The invention further includes means for interconnecting the support and tie structure to the membrane-holding means. In one embodiment of the invention, this interconnecting means comprises a base channel (33) having upper and lower, outwardly extending horizontal legs. The base channel (33) has a central aperture (36) which accommodates the membrane-holding means (14). In an alternate embodiment of the invention, the interconnecting means comprises a clamp (43) having a U-shaped portion which engages with a vertical anchor rod (41). The method comprises constructing the substrate wall; attaching a plurality of membrane-holding base members to the substrate wall; applying adhesive to the substrate wall; mounting the waterproof membrane against the substrate wall and over the base members; attaching interconnecting means to the membrane holder; connecting an anchor and tie structure to the interconnecting means; constructing the veneer wall; and positioning a tie between adjacent veneer units, so that the veneer is anchored securely to the substrate wall, but the membrane is not punctured.

15 Claims, 4 Drawing Sheets

33
34
36
35
48
49
22
23
24
10
20
11
21
19
14
15
12
13
46
47
5
31

NON-PENETRATING VENEER ANCHOR

FIELD OF THE INVENTION

The present invention relates to building construction, and more particularly to an anchoring system for tying a veneer wall to a substrate wall in which a waterproofing membrane between the veneer and substrate walls is not punctured.

BACKGROUND OF THE INVENTION

In building construction, the exterior wall often consists of a substrate wall, such as concrete block, which is covered on its exposed face by some type of veneer finish such as stone, brick or siding. This veneer layer provides an enhanced aesthetic appearance and additional structural integrity. It is necessary to connect or "tie" the veneer wall to the substrate wall in order to ensure structural stability and to resist lateral pressure, such as that resulting from wind forces. Also, it is often desirable to maintain a gap between the substrate and veneer wall for ventilation and drainage purposes or to accommodate a layer of insulating material. Veneer anchors spaced along the wall in the vertical and horizontal directions are commonly used to fasten or tie back the veneer to the substrate wall.

Besides being pleasing in appearance, an acceptable exterior wall for a building must also offer protection against water seepage. An effective and common way of preventing leaks is to apply a durable, continuous, waterproof membrane to the outside of the substrate wall, behind the veneer.

However, the anchors used in the construction industry to secure the veneer to the substrate puncture the interstitial waterproof membrane at each anchor point. This penetration of the membrane results in a noncontinuous seal which could result in a leak. Even caulking around the penetration, as is typically done, does not fully solve the leakage problem. Indeed, the most common point of leakage with conventional anchors is at the points of anchor penetration.

A non-penetrating fastener was disclosed in U.S. Pat. No. 4,519,175, issued to Resan and assigned to Carlisle Corporation. This lubricated non-penetrating membrane fastener is designed to be used to secure a waterproof roofing membrane to a roof, but has no application as an anchoring system for a veneer wall.

The present invention addresses these and many other problems associated with currently available veneer anchoring systems.

SUMMARY OF THE INVENTION

The present invention comprises an anchoring system for fastening a plurality of veneer units to a substrate wall with a waterproof membrane therebetween. The anchoring system comprises a membrane-holding means which is attached to the substrate wall and holds the membrane proximate the wall without puncturing the membrane. The anchoring system also includes an anchor and tie structure including a substantially stationary anchor, with a vertically slidable, horizontal tie which is positioned between adjacent units of veneer for stabilization of the masonry veneer wall. The invention further includes means for interconnecting the anchor and tie structure to the membrane-holding means. In one embodiment of the invention, this interconnecting means comprises a base channel having upper and lower, outwardly extending horizontal legs with a substantially vertical plate therebetween. The plate has a central aperture which accommodates the membrane-holding means. In an alternate embodiment of the invention, the interconnecting means comprises a clamp having a U-shaped portion which engages with a vertical anchor rod.

According to another aspect of the invention, a method for fastening a plurality of veneer units to a substrate wall with a waterproof membrane sheet therebetween is disclosed. The method comprises constructing the substrate wall; attaching a plurality of membrane-holding base members to the substrate wall; applying adhesive to the substrate wall; mounting the waterproof membrane against the substrate wall and over the base members; attaching interconnecting means to the membrane holder; connecting an anchor and tie structure to the interconnecting means; constructing the veneer wall by placing mortar between adjacent veneer units; and positioning a tie or horizontal extension portion between adjacent veneer units, so that the veneer is anchored securely to the substrate wall, but the interstitial membrane is not punctured.

A particular advantage of the present invention is that it prevents leakage through a wall's waterproof membrane by eliminating puncturing and stressing of the membrane at the anchor points. At the same time, the anchoring system of the present invention provides a secure, structurally sound connection between the substrate wall and the veneer.

Another feature of the present invention is that it can be used in conjunction with a wide variety of conventional masonry tie systems. The present invention does not require a redesigned or retrofitted masonry tie structure, but can be used with the masonry tie systems commonly used.

Still another advantage of the present invention is that it is simple in construction and relatively inexpensive. It can be installed with ease during the construction process with a minimum amount of labor time.

For a better understanding of the invention, and of the advantages obtained by its use, reference should be had to the drawings and accompanying descriptive manner, in which there is illustrated and described a preferred embodiment of the invention.

BRIEF DESCRIPTION OF THE DRAWINGS

Referring particularly to the drawings, wherein like reference numerals indicate like parts throughout the several views.

DETAILED DESCRIPTION OF THE PREFERRED EMBODIMENT

Figures 1, 2, 3:
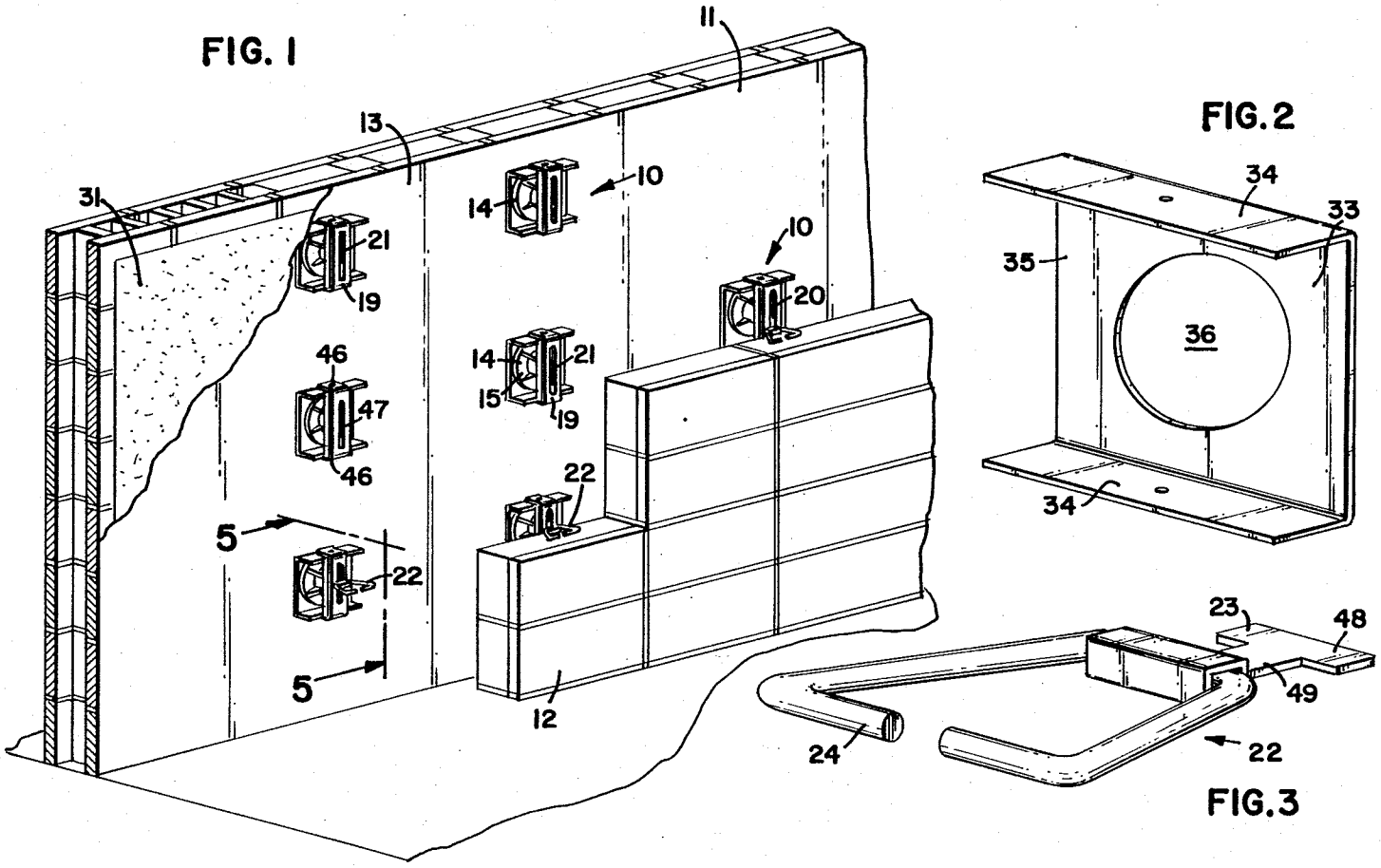
FIG. 1 is a perspective view of the first embodiment of the non-penetrating veneer anchor of the present invention as installed between a substrate wall and veneer wall.
FIG. 2 is a perspective view of the base channel used with the first embodiment of the present invention.
FIG. 3 is a perspective view of an anchor and tie structure used with the present invention.

The first embodiment of the non-penetrating veneer anchor of the present invention is shown generally at 10. The anchoring system 10 is used to securedly fasten or "tie back" a substrate wall 11 to an outer veneer surface wall 12. FIG. 1 illustrates a concrete block wall as the support wall or substrate wall 11 and stone-faced masonry units as the veneer 12. However, it is to be understood that the present invention could be used with a wide variety of commonly used substrate walls and veneers. For example, a steel stud wall, a wood stud wall, or a poured concrete wall could be utilized for the substrate wall; and stone, brick or siding could be utilized for the veneer wall. Preferably, there is a gap between the substrate wall and the veneer wall of two (2) or three (3) inches to accommodate the anchoring system of the present invention, and for drainage and insulating purposes.

Figure 5:
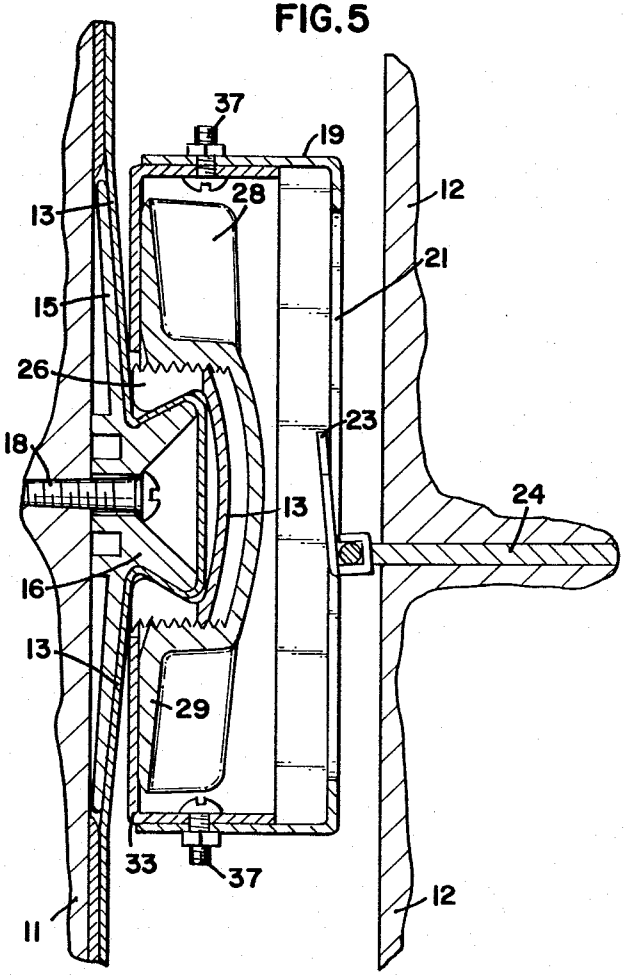
FIG. 5 is a side view, partially in section, of the anchoring system shown in FIG. 4, taken along line 5—5 of FIG. 1.
Figure 4:
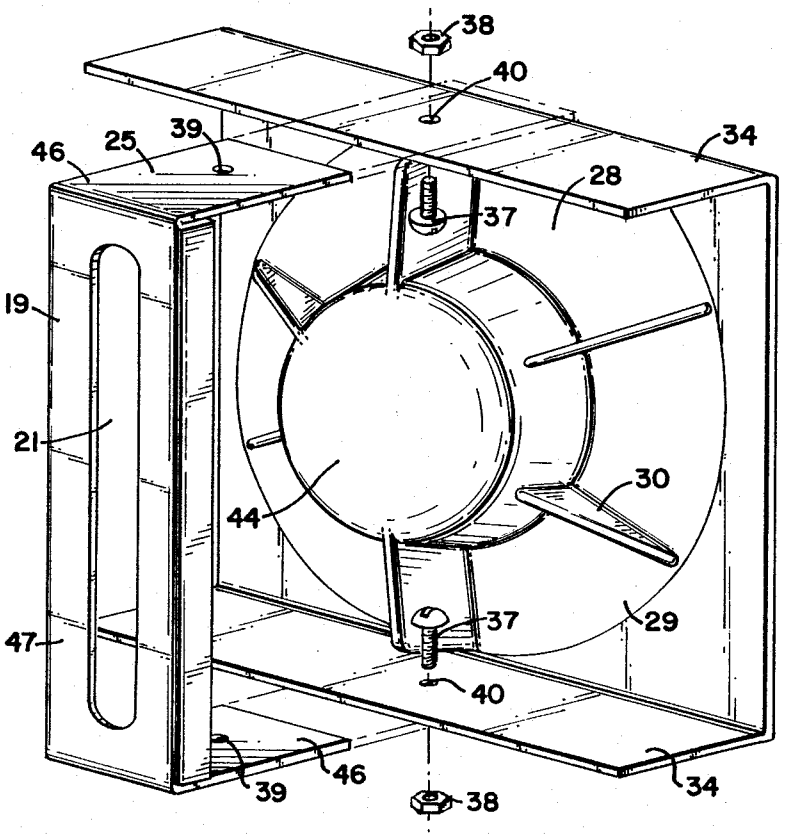
FIG. 4 is a perspective, exploded view of the first embodiment of the non-penetrating veneer anchor of the present invention.
Figure 6:
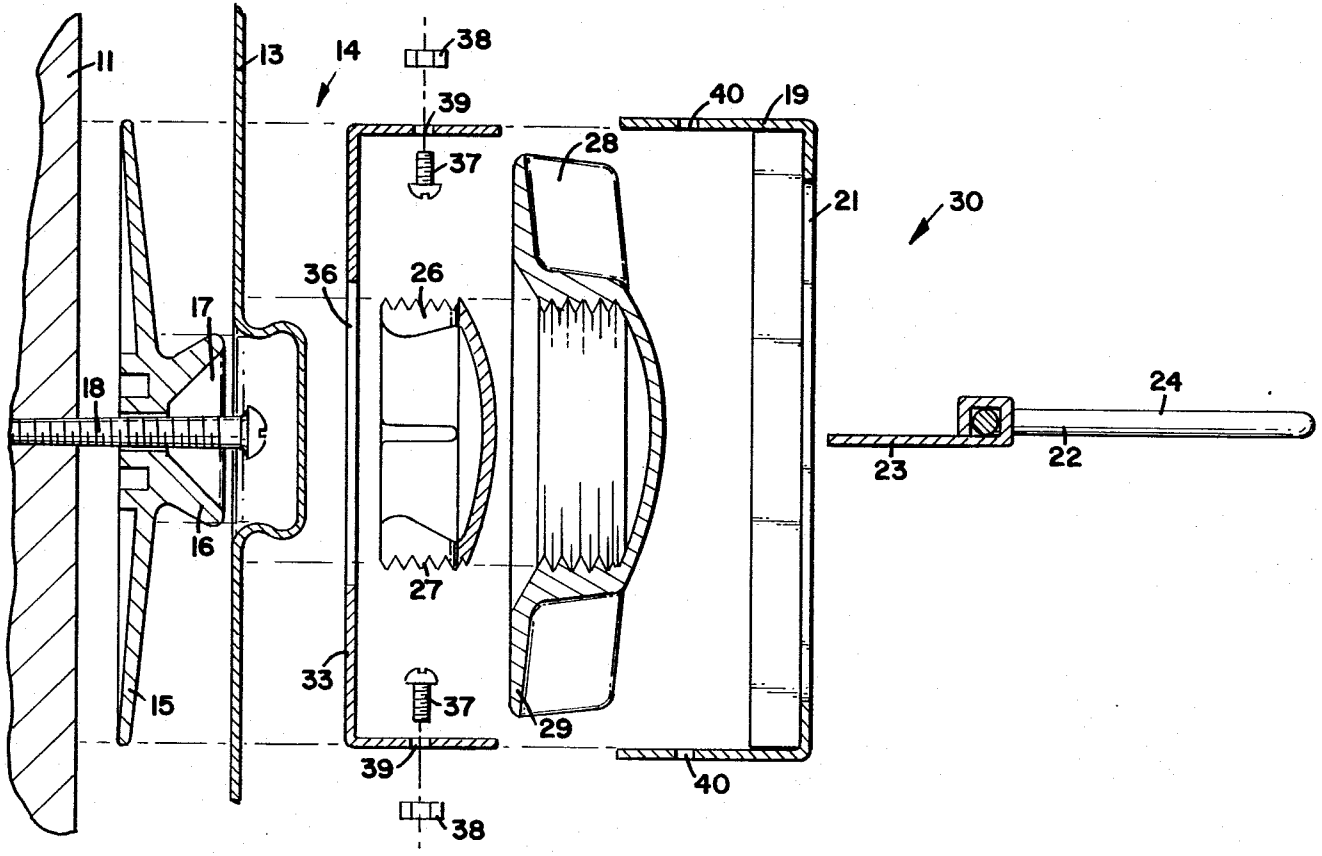
FIG. 6 is an exploded side view, partially in section, of the anchoring system shown FIGS. 4 and 5.

A plurality of membrane-holding means 14 are suitably attached to the substrate wall at spaced intervals to hold the membrane against the substrate wall without puncturing it. Preferably, the membrane-holding means 14 are spaced approximately three (3) feet apart in the vertical and horizontal directions. The membrane-holding means 14 includes a base portion 15 and a cover portion 26 between which the waterproof membrane 13 is disposed, as shown in FIG. 5 and discussed in detail below.

An example of a suitable membrane-holding means 14 is disclosed in U.S. Pat. No. 4,519,175, issued to Resan and illustrated in the Figures herein. The membrane-holding means 14 includes a base or anchor disc 15 having a central, outwardly-extending frusto-conical stub 16. The interior 17 of the stub 16 receives a suitable fastener 18, such as a screw or a nail, which fastens within the substrate wall 11 to hold the anchor disc 15 against the substrate wall 11. A plurality of anchor discs 15 are secured to the substrate wall surface 11 at spaced intervals, as shown in FIG. 1. Conventional adhesive 31 is then applied to the substrate wall around the anchor discs 15. The continuous roofing membrane 13 is then mounted to the substrate wall, completely covering the wall 11 and the anchor discs 15.

In the preferred embodiment, the membrane 13 is held in place over the anchor discs 15 by a circular, tined retainer cap 26, which is adapted to fit over and clamp onto the stub or button 16. Thus, the waterproof membrane is held between the button 16 of the anchor disc 15 and the retainer cap 26. The retainer cap 26 has an externally threaded cylindrical sidewall 27, and the retainer cap 26 is dimensioned to allow clearance for the rubber membrane 13. Preferably, the retainer cap 26 is lubricated with a permanent lubricant which serves to minimize damage to the membrane 13 when the retainer cap 26 is placed over the membrane and button 16.

The membrane-holding means 14 also includes an internally threaded cover 28 which is screwed onto the retainer cap 26. The cover 28 serves to squeeze the sidewalls 27 of the retainer cap 26 against the button 16, which prevents the retainer cap 26 from popping off the button 16 and releasing the membrane 13. The cover 28 may include a peripheral flange 29 which flattens the membrane 13 against the anchor disc 15. The cover 28 may also include a plurality of fins 30 which enable the cover 28 to be grasped and rotated with the hand.

An anchor and tie structure used with the present invention to tie the substrate wall 11 to the veneer 12 is shown generally at 20 in FIG. 1. It is to be understood that a wide variety of anchor and tie structures could be utilized with the present invention. The anchor and tie structure 20 includes a stationery bracket 19 interconnected with a movable tie 22. The bracket or anchor 19 has an elongated, vertical leg 47 with a vertical channel slot 21 therein. On each longitudinal end of anchor 19 is a relatively short, outwardly-extending flange 46.

The tie or horizontal extension portion 22, illustrated in FIG. 3, includes a curved rod having two legs 24 which lie in a substantially horizontal plane. A wide variety of configurations could be utilized for the horizontal extension rod 24. Interconnected to the rear end of the rod is a T-shaped back plate 23 having a rear wide portion 48 and intermediate narrow portion 49. The back plate 23 is insertable within the longitudinal channel slot 21 of the anchor 19. As can be seen, the tie 22 is vertically adjustable with respect to the anchor 19 so that a mason has no difficulty in positioning the extension rods 24 of the tie 22 between adjacent masonry units for stabilization of the veneer wall. The tie 22 is sandwiched #between adjacent units of veneer and is secured in place with mortar. Vertical adjustment of the tie 22 is accomplished by merely sliding the back section plate 23 of the tie 22 within the slot 21 in the vertical direction.

The present invention also includes means for interconnecting the membrane-holding means 14 to the anchor and tie structure 20. The first embodiment of the interconnecting means is illustrated in FIGS. 1–6. The interconnecting means or base channel 33 includes a pair of upper and lower, outwardly-extending, horizontal legs 34 interconnected by a substantially vertical flat plate 35 therebetween. In the preferred embodiment, the dimensions of the base channel 33 are substantially square, being approximately three and three-quarter ($3\frac{3}{4}$) inches in both length and width. In the preferred embodiment, the depth of the legs 34 is about one (1) inch. The plate 35 has a central circular aperture 36. The aperture 36 is sized and configured to be slightly larger than the diameter of the retainer cap 26, so that the retainer cap 26 is insertable therethrough. The distance between the upper and lower legs 34 is larger than the diameter of the cover 28, so that the cover 28 can be fitted over the retainer cap 26 and positioned between the upper and lower legs 34. The flat plate 35 of the base channel 33 is sandwiched between the waterproof membrane 13 and the peripheral flange 29 of the cover 28, as shown in FIG. 5's sectional view and FIG. 6's exploded view. In this manner, the cover 28 serves to prevent the retainer cap 26 and base channel 33 from moving. The interconnection means or base channel 33 is attached to the anchor and tie structure 20 by suitable fasteners, such as the bolt 37 and nut 38 arrangement shown in FIG. 4. In the preferred embodiment, the bolt 37 is insertable through apertures 39 in the flanges 25 of the anchor 19 and through suitably aligned apertures 40 in the legs 34 of the base channel 33. Preferably, the flanges 25 of the anchor 19 are inserted within the base channel 33, so that the legs 34 are flush against the outside of the flanges 25.

The design of the present invention allows the substrate wall and veneer wall to move slightly in the vertical direction relative to each other. During the construction process, there is commonly a slight vertical movement due to settling, for example, about one-quarter ($\frac{1}{4}$) of an inch between the time of construction and the time of loading. The present invention allows this vertical movement to occur without placing stress on the fastener 14.

Figure 8:
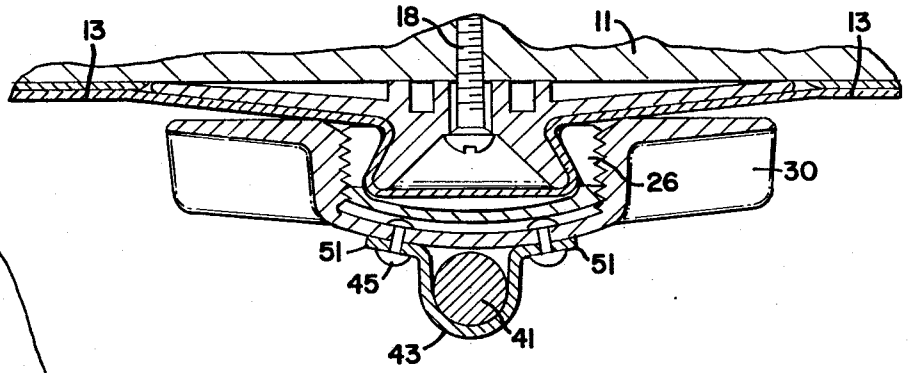
FIG. 8 is a top view, partially in section, of the anchoring system shown in FIG. 7, taken along line 8—8 of FIG. 7.
Figure 7:
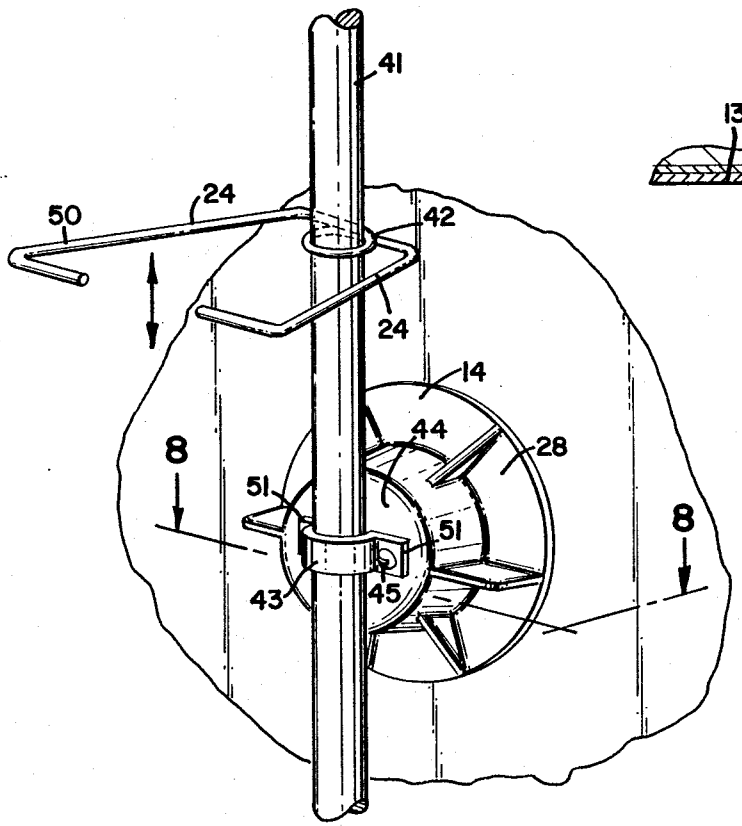
FIG. 7 is a perspective view of the second embodiment of the non-penetrating veneer anchor of the present invention.

An alternate embodiment of the present invention is illustrated in FIGS. 7–8. In this embodiment, the configuration of the tie or horizontal extension portion 50 is slightly different than the shape of the tie 22 shown in FIG. 3. The tie 50 has two horizontal rod-like legs interconnected by a central loop portion 42. The tie 50 is interconnected to a vertical anchor rod 41 by the loop 42. In the preferred embodiment, the anchor rod 41 is three-eighths ($\frac{3}{8}$) inch in diameter and the loop 42 is slightly larger so that the loop 42 is vertically slidable upon the rod 41. The anchor rod 41 preferably extends from the ground to the height of the upper row of anchor discs 15 proximate the top of the veneer wall 12. Rather than having a base channel 33 as the interconnecting means, the anchor rod 41 in the alternate embodiment is interconnected to the membrane-holding means 14 by means of a clamp 43. The clamp 43 has a central portion with a substantially U-shaped cross-section which is sized to accommodate the anchor rod 41. The clamp 43 also has a pair of outer flanges 51 which are positioned flush against the surface of the retainer cap 28. The flanges 51 of the clamp 43 are preferably connected to the top 44 of the cover 28 by means of suitable fasteners 45, such as bolts or rivets.

In summary, the anchoring system of the present invention is installed as follows. The bases or anchor discs 15 are attached to the substrate wall 11 at spaced intervals by means of screws 18. Adhesive 31 is then applied to the substrate wall around the base caps 15. A continuous sheet of waterproof membrane 13 is then applied to the wall and over the base caps 15, and the membrane is held in place by the adhesive 31. In the first embodiment of the invention, the base channel 33 is then positioned upon the base cap 15 so that the button 16 and retainer cap 26 extend through the aperture 36 in the base channel 33. The cover 28 is then attached. Next, the anchor 19 and tie 22 structure is interconnected to the base channel 33 by means of suitable fasteners 37. In the alternate embodiment, the base channel 33 is not installed. Rather, the vertical rods 41 are installed after the cover 28 is in place and the two parts are interconnected by means of the clamp 43.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described but to cover all modifications that may fall within the scope of the appended claims.

What is claimed is:

1. An anchoring structure fastening a plurality of veneer units to a substrate wall with a waterproof membrane therebetween, said anchoring system comprising:

(a) membrane-holding means, attached to said substrate wall, for holding a waterproof membrane proximate said substrate wall without puncturing said membrane, including a base and a cover between which said membrane is disposed;

(b) a substantially horizontal tie slidably mounted upon a substantially stationary anchor, said tie being positioned between adjacent units of veneer for stabilization thereof, said anchor and tie being disposed between said substrate wall and said veneer; and (c) means for interconnecting said anchor to said membrane-holding means.

2. The anchoring structure according to claim 1, wherein said membrane-holding means comprises:

(a) an anchor disc attached to said substrate wall, said disc including a central, frusto-conical button;

(b) an externally threaded retainer cap adapted to snap onto said button of said anchor with said membrane held between said retainer and said button; and (c) an internally threaded cover adapted to screw onto said externally threaded retainer cap to hold said retainer cap, membrane and button in position, said cover including a peripheral flange.

3. The anchoring structure according to claim 2, wherein said interconnecting means comprises a base channel having legs with a vertical plate therebetween, said legs being operatively interconnected to said anchor, said plate including an aperture therewithin to accommodate said anchor disc, said plate being positioned between said membrane and said peripheral flange of said cover.

4. The anchoring structure according to claim 2, wherein said interconnecting means comprises a clamp operatively connected to said cover of said membrane-holding means, and a vertical anchor rod operatively interconnected to both said clamp and said support and tie structure.

5. The anchoring structure according to claim 3, wherein said stationary anchor has a vertical longitudinal channel slot and said tie includes a back plate, a portion of which is insertable in said channel slot so as to be movable vertically.

6. The anchoring structure according to claim 4, wherein said anchor comprises a vertical rod and said tie has a loop on one thereof through which said vertical rod is inserted so that said tie is movable in a vertical direction.

7. The anchoring structure according to claim 5, wherein said legs of said base channel are interconnected to said anchor by means of a plurality of bolts.

8. The anchoring structure according to claim 6, wherein said clamp includes a U-shaped portion which is sized and configured to accommodate said rod and a flange on each side of said U-shaped portion.

9. An anchoring structure for fastening a plurality of veneer units to a substrate wall with a waterproof membrane therebetween, said anchoring structure comprising:

(a) membrane-holding means for holding a waterproof membrane proximate said substrate wall without puncturing said membrane, said membrane-holding means including:

(i) an anchoring disc attached to said substrate wall, said disc including a central, frusto-conical button;

(ii) an externally threaded retainer cap adapted to snap onto said button of said anchor with said membrane held between said retainer and said button; and (iii) an internally threaded cover adapted to screw onto said externally threaded retainer cap to hold said retainer cap, membrane and button in position, said cover including a peripheral flange, (b) a stationary anchor having a vertical longitudinal channel slot in which a horizontal tie is slidably interconnected, an opposite end of said tie being positioned between adjacent units of veneer; and (c) a base channel having horizontal, outwardly extending upper and lower legs interconnected by an integral vertical plate therebetween having a central round aperture, said upper and lower legs being operatively interconnected to an upper and lower end of said stationary anchor respectively, said anchoring disc being insertable through said aperture so that said plate is positioned between said membrane and said peripheral flange of said cover.

10. A method for fastening a plurality of veneer units to a substrate wall with a waterproof membrane sheet therebetween, said anchoring system comprising:

(a) constructing said substrate wall;

(b) attaching a plurality of base members to said substrate wall;

(c) applying adhesive to said substrate wall;

(d) mounting said waterproof membrane against said substrate wall and over said base members, wherein said waterproof membrane is held to said substrate wall by said adhesive;

(e) positioning a cover member over each of said base members to hold said membrane therebetween, wherein said membrane is not punctured;

(f) attaching interconnecting means to each of said cover members for connecting said cover members to an anchor and tie structure;

(g) connecting said support and tie structure to said interconnecting means, wherein a plurality of ties are slidably mounted upon substantially stationary supports;

(h) constructing said veneer wall by placing mortar between adjacent veneer units; and (i) positioning said ties between adjacent veneer units, wherein said veneer is anchored securedly to said substrate wall.

11. The method of claim 10, wherein said attachment of interconnecting means step comprises positioning a base channel having a central aperture and upper and lower legs over said base member so that said base member extends through said aperture and said base channel is disposed between said membrane and said cover member.

12. The method of claim 10, wherein said attachment of interconnecting means step comprises fastening a clamp to said cover, said clamp including a U-shaped portion, and inserting an anchor rod through said semicircular portion of said clamp.

13. The method of claim 10, further comprising the step of installing insulating material between said substrate wall and said veneer units.

14. A method for fastening a plurality of veneer units to a substrate wall with a waterproof membrane sheet therebetween, said anchoring system comprising:

(a) constructing said substrate wall;

(b) attaching a plurality of base members to said substrate wall;

(c) applying adhesive to said substrate wall;

(d) mounting said waterproof membrane against said substrate wall and over said base members, wherein said waterproof membrane is held to said substrate wall by said adhesive;

(e) positioning a base channel having a central aperture and upper and lower legs over each of said base members whereby said base member and membrane extends through said aperture;

(f) operatively connecting a cover member over said base member so that said membrane is held unpunctured therebetween and said base channel is disposed between said base member and said cover member;

(g) interconnecting said anchor to said upper and lower legs of said base channel by means of a suitable fastener in each leg;

(h) constructing said veneer wall by placing mortar between adjacent veneer units; and (i) positioning a tie between adjacent veneer units, wherein said veneer is anchored securedly to said substrate wall.

15. A method for fastening a plurality of veneer units to a substrate wall with a waterproof membrane sheet therebetween, said anchoring system comprising:

(a) constructing said substrate wall;

(b) attaching a plurality of base members to said substrate wall;

(c) applying adhesive to said substrate wall;

(d) mounting said waterproof membrane against said substrate wall and over said base members, wherein said waterproof membrane is held to said substrate wall by said adhesive;

(e) positioning a cover member over each of said base members to hold said membrane therebetween, wherein said membrane is not punctured;

(f) fastening a clamp to said cover, said clamp including a substantially U-shaped portion;

(g) inserting a rod through said U-shaped portion of said clamp so that said rod is substantially vertical and extends substantially the height of said veneer wall;

(g) connecting a tie having a central loop portion to said rod by inserting said rod through said loop portion;

(h) constructing said veneer wall by placing mortar between adjacent veneer units; and (i) positioning a tie between adjacent veneer units, wherein said veneer is anchored securedly to said substrate wall.

* * * * *